US006690899B2

(12) United States Patent
Brown et al.

(10) Patent No.: US 6,690,899 B2
(45) Date of Patent: Feb. 10, 2004

(54) CONDUCTIVE FIBER BRUSH CLEANER HAVING SEPARATE DETONING AND SCAVENGING ZONES

(75) Inventors: Kenneth J. Brown, Rochester, NY (US); George David Gross, Rochester, NY (US); Joseph A. Kwiatkowski, Rochester, NY (US); Francisco L. Ziegelmuller, Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/080,215

(22) Filed: Feb. 21, 2002

(65) Prior Publication Data

US 2003/0044207 A1 Mar. 6, 2003

Related U.S. Application Data

(60) Provisional application No. 60/317,393, filed on Sep. 5, 2001.

(51) Int. Cl.[7] ..... G03G 21/00

(52) U.S. Cl. ..... 399/102; 399/353; 399/358

(58) Field of Search ..... 399/98, 101, 102, 399/353, 354, 358, 360

(56) References Cited

U.S. PATENT DOCUMENTS 4,819,026 A * 4/1989 Lange et al. ..... 399/358 X
5,991,568 A * 11/1999 Ziegelmuller et al. ..... 399/102
6,453,147 B1 * 9/2002 Morse et al. ..... 399/353

* cited by examiner

*Primary Examiner*—William J. Royer

(57) ABSTRACT

A conductive fur brush cleaning assembly for an image processing apparatus. The cleaning assembly has a casing, a plurality of rotating components within the casing and a plurality of sealing devices that divide the casing into a scavenging zone and a detoning zone. The sealing devices prevent airborne marking particles from traveling from the detoning zone into the scavenging zone.

11 Claims, 4 Drawing Sheets

CONDUCTIVE FIBER BRUSH CLEANER HAVING SEPARATE DETONING AND SCAVENGING ZONES

CROSS REFERENCE TO RELATED APPLICATION

Reference is made to and priority claimed from U.S. Provisional Application Serial No. 60/317,393, filed, Sep. 5, 2001 entitled DETONE CLEANER HAVING SEPARATE ZONES USING FLAPS.

BACKGROUND OF THE INVENTION

1. Field of the Invention

The present invention relates in general to a cleaning assembly for, an electrostatographic marking engine, and more particularly to a cleaning assembly which is separated into different zones to prevent airborne waste toner particles from migrating from the detone zone to the scavenging zone.

2. Description of the Related Art

In a typical commercial reproduction apparatus (electrostatographic copier/duplicators, printers, or the like), a latent image charge pattern is formed on a uniformly charged dielectric member such as a belt or drum. Pigmented marking particles are attracted to the latent image charge pattern to develop such images on the dielectric member. Printing material, commonly referred to as a receiver member, is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser apparatus at a downstream location. There, the image is fixed to the receiver member by heat and/or pressure from the fuser apparatus to form a permanent reproduction thereon.

However, not all of the marking particles are transferred to the receiver member and some remain upon the dielectric member. Therefore, a cleaning assembly is commonly used to remove the excess marking particles. The cleaning assembly usually includes an electrostatic cleaning brush, a detoning roller, a skive, and a receptacle to hold the excess marking particles (waste marking particle). The components within the cleaning assembly generally rotate to remove waste particles.

However, a problem occurs when marking particles that are removed from the detoning roller by the skive becomes airborne and are attracted back to the cleaning brush. This reduces the efficiency of the cleaning assembly because waste marking particles may have to be removed from the cleaning brush a number of times before it reaches the waste marking particle receptacle. More importantly, it is also possible for such airborne waste marking particles to be carried outside the cleaning assembly through the viscous boundary layer of air created due to the rotation of the cleaning brush. If these waste marking particles exit in the cleaning assembly, it can contaminate the outside surfaces of the cleaning assembly and/or the remaining portions of the image processing apparatus. Therefore, there is a need to prevent waste marking particles that are removed from the detoning roller from becoming airborne and re-entering the scavenging zone of the cleaning assembly. The invention discussed below addresses this problem by providing a solution that uses flaps or some similar device to divide the cleaning assembly into a scavenging zone and a detoning zone whereby, once the waste particles enter the detoning zone, they are prevented from re-entering the scavenging zone.

SUMMARY OF THE INVENTION

In view of the foregoing and other problems, disadvantages, and drawbacks of the conventional cleaning assembly, the present invention has been devised, and it is an object of the present invention, to provide a structure and method for an improved cleaning assembly.

In order to attain the object suggested above, there is provided, according to one aspect of the invention a conductive fur brush cleaning assembly for an image processing apparatus. The cleaning assembly includes a casing, a plurality of rotating components within the casing, and a plurality of sealing devices that divide the casing into a scavenging zone and a detoning zone. The sealing devices prevent airborne waste marking particles from traveling from the detoning zone into the scavenging zone. The rotating components include a detoning roller in contact with at least one of the sealing devices. The cleaning assembly sealing devices can comprise a plush fabric seal or a flap. The sealing devices have sufficient rigidity to maintain contact with the rotating components while the rotating components are rotating. The sealing devices can be air curtains, flaps, and/or plush fabric seals.

The invention also includes a method of controlling airborne waste marking particles in a conductive fur brush cleaning assembly for an image processing apparatus. The method comprises producing rotating components within a casing, and dividing the casing into a scavenging zone and a detoning zone using sealing devices. The sealing devices prevent the airborne waste marking particles from traveling from the detoning zone into the scavenging zone.

Thus, the invention physically separates the cleaning assembly into a scavenging zone and a detoning zone using, for example, flaps or plushes. Such physically separated zones reduce the volume of waste marking particles from the scavenging zone to increase the cleaning efficiency of the operating components in the scavenging zone. By providing physical structures that create zones, the invention is superior to conventional structures and contains waste marking particles within the detoning zone, thereby reducing waste toner contamination of the cleaning (detoning) components of the cleaning assembly.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF PREFERRED EMBODIMENTS OF THE INVENTION

Figure 1A:
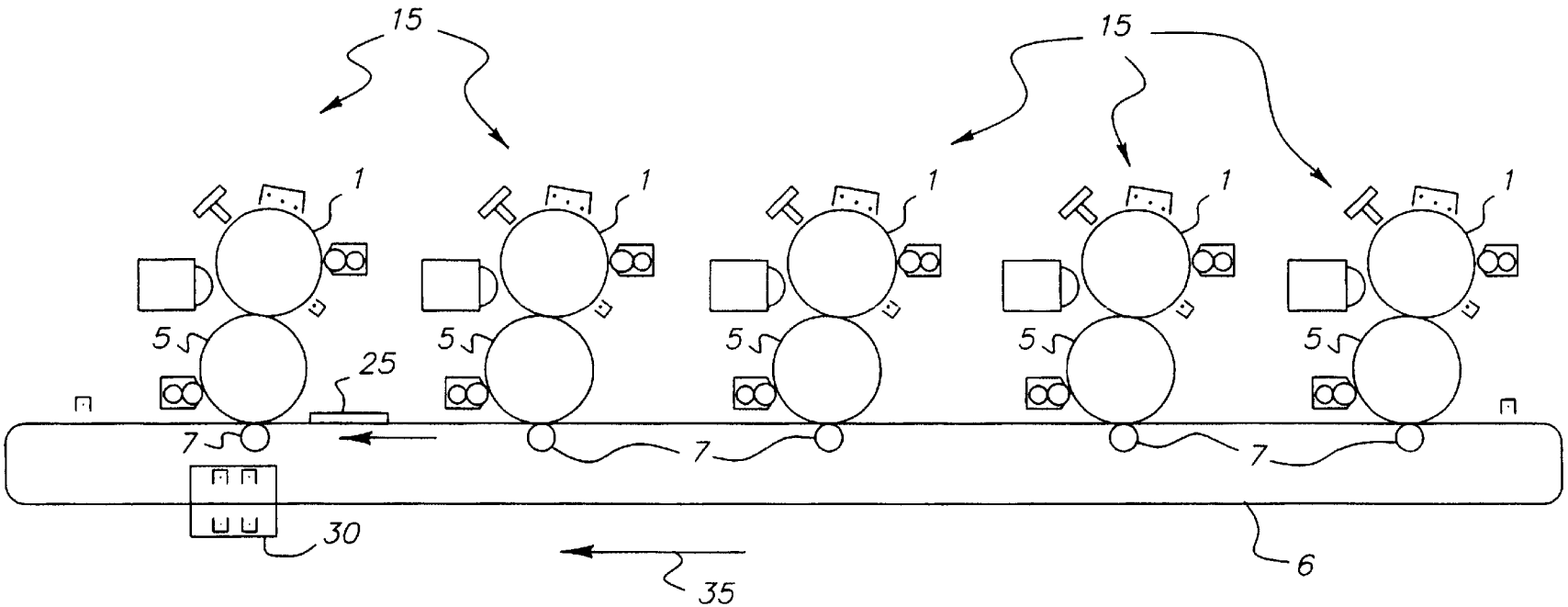
FIGS. 1A and 1B are side elevation schematic views of a color print apparatus utilizing a cleaning assembly of the invention.
Figure 1B:
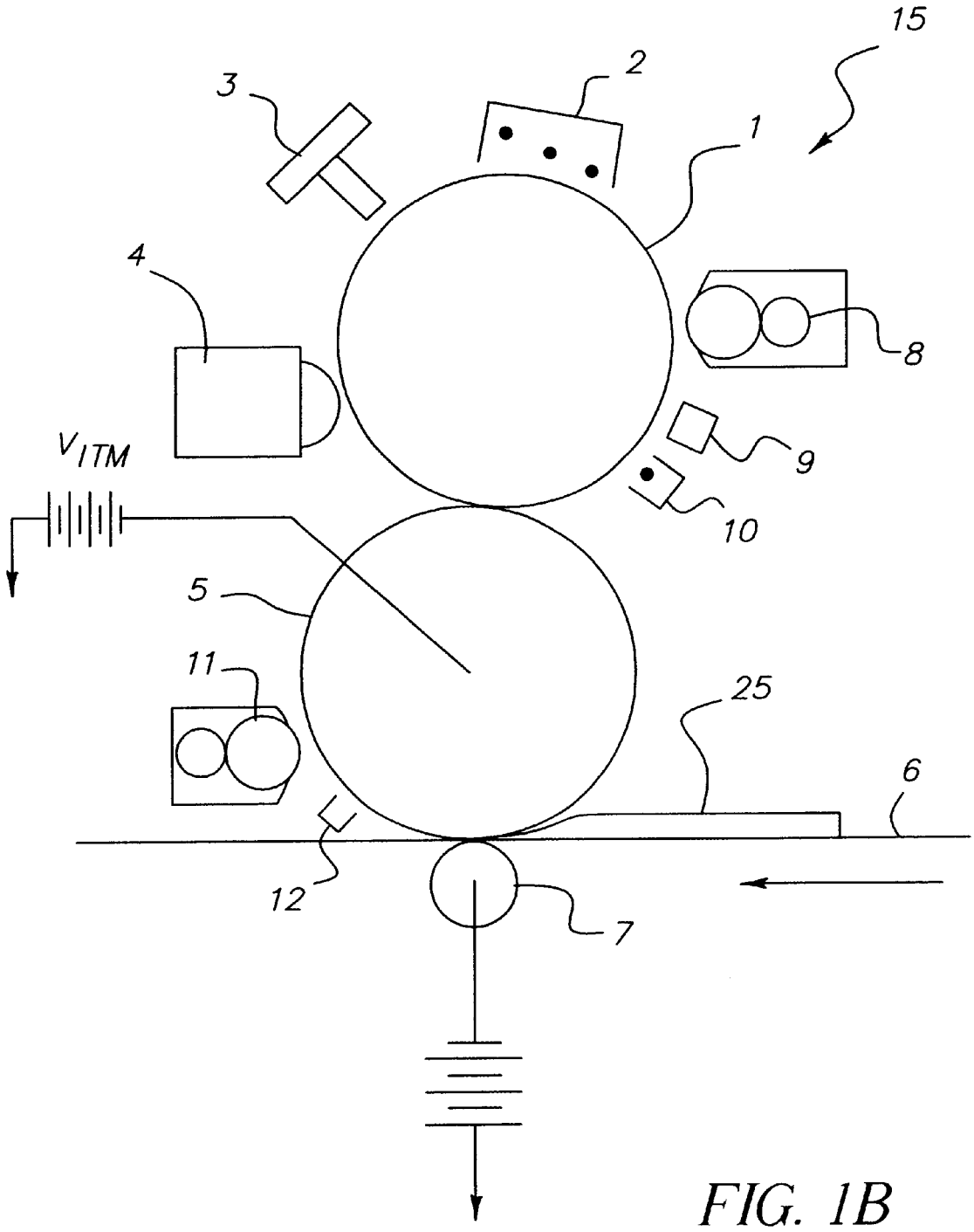

FIG. 1A illustrates an apparatus in which the invention may be used. A conveyor 6 is drivable to move a receiving sheet 25 (e.g., paper, plastic) past a series of imaging stations 15. One of the imaging stations 15 is shown in greater detail in FIG. 1B.

With the invention, a primary image member (for example, a photoconductive drum) 1 within each imaging station 15 is initially charged by a primary charging station 2. This charge is then modified by a printhead 3 (e.g., LED printhead) to create an electrostatic image on the primary image member 1. A development station 4 deposits marking particles on the primary image member 1 to form a marking particle image corresponding to the color toner in each individual imaging station 15. The marking particle image is electrostatically transferred from the primary image member 1 to an intermediate transfer member, for example, an intermediate transfer roller or drum 5. While both of the primary image member 1 and the intermediate transfer drum 5 are shown as drums, as would be known by one of ordinary skill in the art, these could also include belts or similar image transfer surfaces. The primary image member 1 and the intermediate transfer drum 5 are used in these examples to simplify the explanation of the invention; however, the invention is not limited to drums, but instead, is applicable to all similar structures/surfaces.

Figure 2:
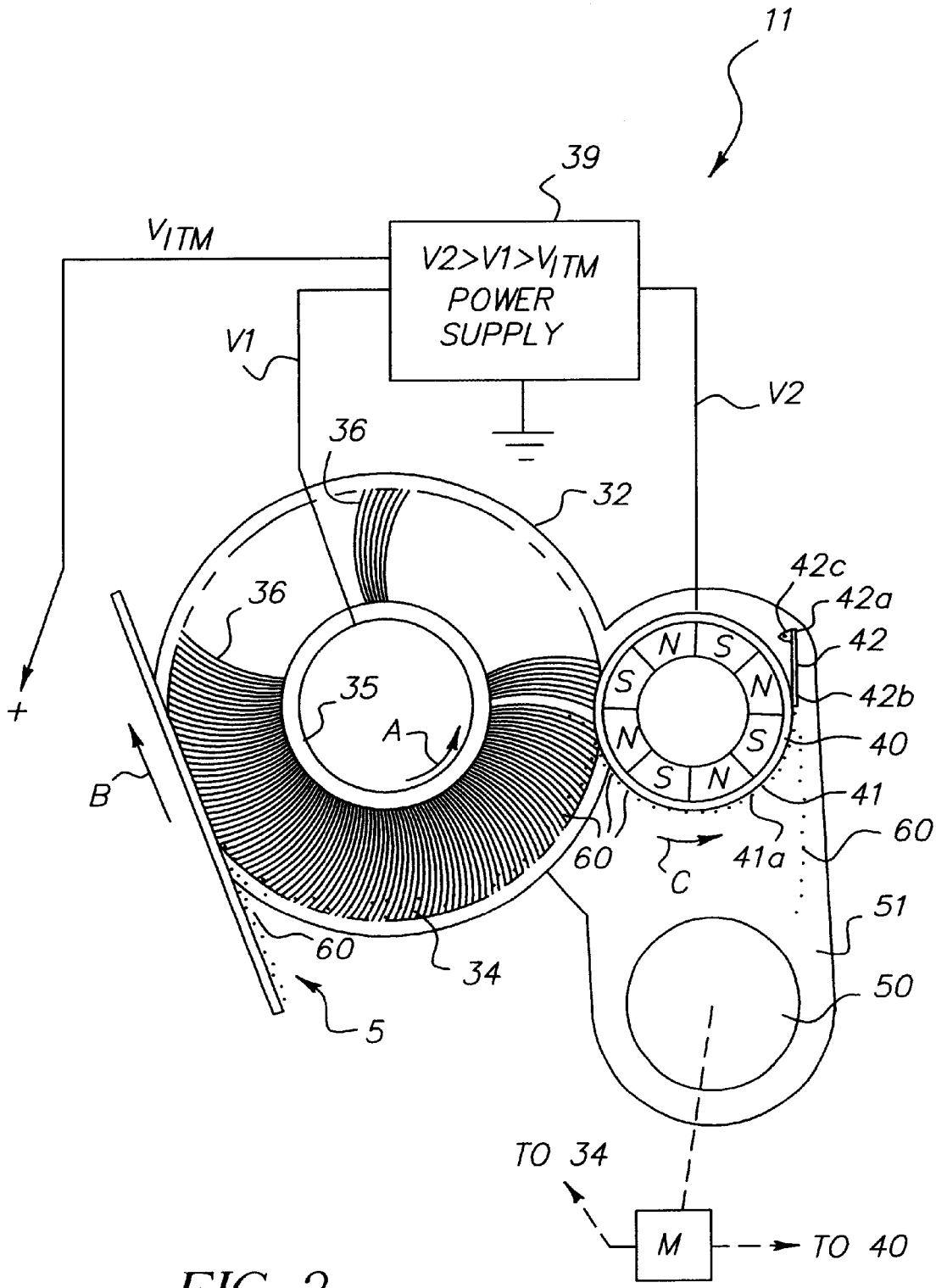
FIG. 2 is a side elevation schematic view showing in greater detail the cleaning assembly forming a part of the apparatus of FIG. 1.

After the charged marking particles are transferred to the intermediate transfer drum 5, there still remains some waste marking particles that need to be removed from the primary image member 1. The invention uses a pre-cleaning erase light emitting diode (LED) lamp 9 in combination with a pre-cleaning charging station 10 in order to electrostatically modify the surface potential of the non-image areas of the primary image member 1 and the charge on the waste marking particles remaining on the primary image member 1, respectively. In addition, a cleaning station 8 is included to physically remove any remaining waste marking particles. The cleaning station 8 is illustrated in FIG. 2 and is discussed in greater detail below.

A transfer nip is used between a transfer backer roller 7 and the intermediate transfer drum 5 to transfer the marking particle image to a receiving sheet 25. In a similar manner to that discussed above, the remaining waste marking particles that remain on the intermediate transfer drum 5 after the marking particle image has been transferred to the receiving sheet 25 are removed using a pre-cleaning charging station 12 and a cleaning station 11. Once again, the details of the cleaning station 11 are shown in FIG. 2 and are discussed below in detail. The receiving sheet 25 is transported by the dielectric conveyor 6 to a fuser 30 where the marking particle image is fixed by conventional means. The receiving sheet 25 is then conveyed from the fuser 30 to an output tray 35.

The marking particle image is transferred from the primary image member 1 to the intermediate transfer drum 5 in response to an electric field applied between the core of intermediate transfer drum 5 and a conductive electrode forming a part of the primary image member 1. The marking particle image is transferred to the receiving sheet 25 at the nip in response to an electric field created between the transfer backer roller 7 and the intermediate transfer drum 5. Thus, intermediate transfer drum 5 helps establish both electric fields. As is known in the art, a polyurethane roller containing an appropriate amount of anti-static material to make it of at least intermediate electrical conductivity can be used for establishing both fields. Typically, the polyurethane or other elastomer is a relatively thick layer; e.g., one-quarter inch thick, which has been formed on an aluminum base.

Preferably, the electrode buried in the primary image member 1 is grounded for convenience in cooperating with the other stations in forming the electrostatic and toner images. If the marking particles are a positively-charged toner, an electrical bias $V_{ITM}$ applied to intermediate transfer drum 5 of typically −300 to −1,500 volts will effect substantial transfer of marking particle images to the intermediate transfer drum. To then transfer the marking particle image onto a receiving sheet 25, a bias, e.g., of −2,000 volts or greater negative voltages, is applied to transfer backer roller 7 to again urge the positively-charged marking particles to transfer to the receiving sheet 25. Schemes are also known in the art for changing the bias on intermediate transfer drum 5 between the two transfer locations so that transfer backer roller 7 need not be at such a high potential.

The intermediate transfer drum 5 has a polyurethane base layer upon which a thin skin is coated or otherwise formed having the desired release characteristics. The polyurethane base layer preferably is supported upon an aluminum core. The thin skin may be a thermoplastic and should be relatively hard, preferably having a Young's modulus in excess of $5\times10^7$ Newtons per square meter to facilitate release of the marking particles to ordinary paper or another type of receiving sheet 25. The base layer is preferably compliant and has a Young's modulus of $10^7$ Newtons per square meter or less to assure good compliance for each transfer.

With reference also now to FIG. 2, the cleaning station 11 comprises a housing 32 which encloses a cleaning brush 34 having conductive fibers (fur) 36 which, through an opening in the housing 32, engage the intermediate transfer drum 5.

The cleaning brush 34 is supported on a core 35 which is driven to rotate by a motor M or other motive source to rotate in the direction of arrow A as the intermediate transfer drum 5 is moved in the direction shown by arrow B. As the cleaning brush 34 rotates, untransferred marking particles 60 and other particulate debris, such as carrier particles and paper dust on the intermediate transfer drum 5, are mechanically scrubbed from the intermediate transfer drum 5 and picked up into the fibers 36 of the cleaning brush 34. The items illustrated in the figures are generally not shown to scale to facilitate understanding of the structure and operation of the apparatus. In particular, the fibers 36 are shown much larger to scale than other structures shown in FIG. 2.

In addition to mechanical scrubbing, an electrical bias is applied to the cleaning brush 34 from power supply 39. An electrical bias V1 of the power supply 39 to the cleaning brush 34 is, as will be more fully explained below, inductively, and not conductively, coupled to the conductive fibers or brush fibers 36. A voltage V1 is greater than the voltage bias $V_{ITM}$ applied to the intermediate transfer drum 5. The polarity of the voltage on the brush fibers 36 is such as to electrostatically attract marking particles 60 to the brush fibers 36. The marking particles 60 entrained within the brush fibers 36 are carried to a rotating detoning roller 40 which is electrically biased by power supply 39 to a higher voltage level V2 than the voltage level V1; i.e., the voltage level V2 is of a level to electrostatically attract the marking particles 60 in the cleaning brush 34 to the detoning roller 40. Assuming a positively-charged marking particle image, as an example, the marking particle image may be attracted to the intermediate transfer drum 5 which is biased to the voltage bias $V_{ITM}$ in the range of about −300 volts to about −1500 volts. The cleaning brush 34, in such an example, would be biased to a potential V1 which is in the range of about −550 volts to about −1750 volts. The detoning roller 40 in this example would be biased to a potential V2 which is in the range of about −800 volts to about −2000 volts. In considering relationships of voltage $V2>V1>V_{ITM}$, the absolute values of the voltages are implied.

The marking particles 60 are electrostatically attracted to the surface 41 of the detoning roller 40. The surface of detoning roller 40 is rotated in the direction of arrow C by a drive force from motor M counter to that of the brush fibers 36 or alternatively in the same direction. The marking particles 60 are carried by the surface 41 of the detoning roller 40 toward a stationary skive blade 42 which is supported as a cantilever at end 42*a* so that the scraping end 42*b* of the skive blade 42 engages the surface 41 of the detoning roller 40.

Marking particles 60 scrubbed from the surface 41 are allowed to fall into a collection chamber 51 of housing 32 and periodically a drive force, such as from motor M or another motive source, is provided to cause an auger 50 or other marking particle transport device to feed the marking particles 60 to a waste receptacle. Alternatively, the waste receptacle may be provided, attached to housing 32, so that marking particles 60 fall into the waste receptacle directly and the auger 50 may be eliminated. In order to ensure intimate contact between the detoning roller surface 41 and the skive blade 42, a permanent magnet is stationarily supported within the hollow enclosure of the detoning roller 40.

The skive blade 42 is made of a metal such as ferromagnetic steel and is of a thickness of less than 0.5 mm and is magnetically attracted by the magnet to the detoning roller surface 41. This effectively minimizes the tendency of the scraping end 42*b* to chatter as the surface 41 travels past the scraping end 42*b* and thus provides more reliable skiving of the marking particles 60 and, therefore, provides improved image reproduction. The skive blade 42 extends for the full working width of the detoning roller surface 41 and is supported at its end 42*a* by ears 42*c* which are soldered to the skive blade 42. A pin extends through a hole in the ears 42*c* to connect the skive blade 42 to the housing 32.

The detoning roller 40 preferably comprises a marking or development roller as is used in known SPD-type development stations which include a core of permanent magnets surrounded by a metal sleeve 41*a*. As a detoning roller 40, the magnetic core is formed of a series of alternately arranged poles (north-south-north-south), permanent magnets that are stationary when in operation. Sleeve 41*a* is formed of polished aluminum or stainless steel and is electrically conductive, but nonmagnetic, so as to not reduce the magnetic attraction of the skive blade 42 to the magnets in the core. The sleeve 41*a* is driven in rotation in the direction of arrow C and is electrically connected to potential V2.

Figure 3:
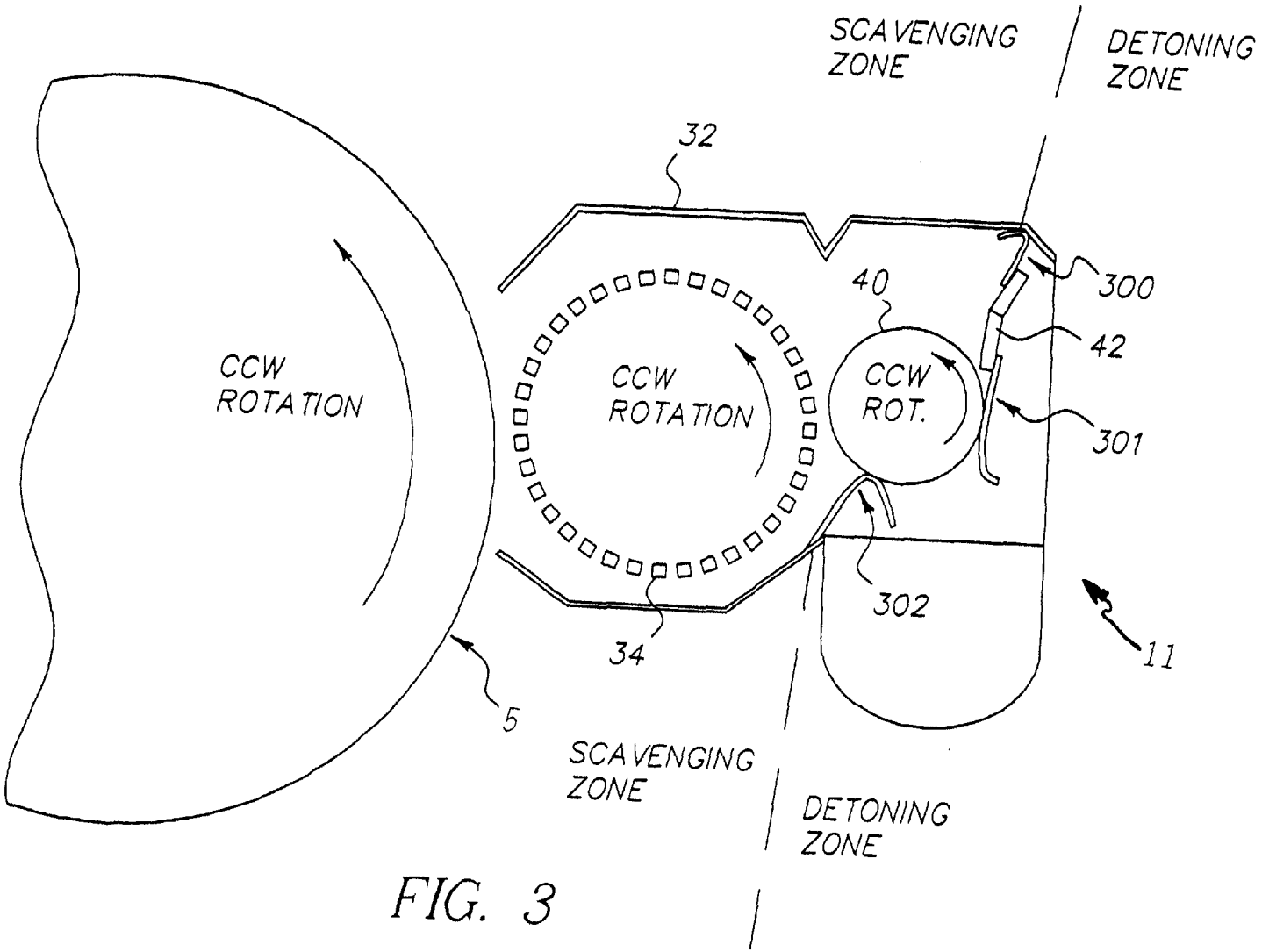
FIG. 3 is a side elevation schematic view showing in greater detail the inventive flaps within the cleaning assembly of FIG. 2.

FIG. 3 illustrates the cleaning assembly 11 shown in FIG. 2 in greater detail. As discussed above, marking particles 60 are removed from the detoning roller 40 by the skive blade 42 become airborne and can be attracted back to the cleaning brush 34. This reduces the efficiency of the cleaning assembly 11 because marking particles 60 may have to be removed from the cleaning brush 34 a number of times before they reach a waste chamber. More importantly, it is also possible for such airborne waste marking particles 60 to be carried outside the cleaning assembly 11 through the viscous boundary layer of air created by the rotation of the cleaning brush 34. If this waste marking particles exit the cleaning assembly 11, it can contaminate the remaining portions of the image processing apparatus. The inventive cleaning assembly 11 shown in FIG. 3 prevents waste marking particles 60 that are removed from the detoning roller 40 from becoming airborne and re-entering the scavenging zone of the cleaning assembly 11. More specifically, the invention addresses this problem by providing a solution that uses flaps 300–302 to divide the cleaning assembly 11 into a scavenging zone and a detoning zone (as conceptually illustrated by the dashed line crossing FIG. 3) whereby, once the waste marking particles 60 enter the detoning zone, they are prevented from re-entering the scavenging zone.

FIG. 3 illustrates an upper skive flap 300 that is connected between the top of the skive blade 42 and the housing or outer casing 32. Additionally, the skive 42 includes a lower skive flap 301 that is rigidly attached to the skive blade 42 and is biased against the detoning roller 40. More specifically, the lower skive flap 301 has sufficient rigidity that it is held against the detoning roller 40. In addition, a bottom flap 302 is connected to the lower part of the outer casing 32 and is biased against the detoning roller 40. Each of the flaps 300–302 includes additional material at the ends of the flaps 300–302 which is curved and extends into the detoning zone. This additional material insures that the flaps 300–302 will continue to make contact with the movable elements (detoning roller 40, skive blade 42) even if there are large size and position variations of the outer casing 32, skive blade 42, detoning roller 40 caused by manufacturing variations. These flaps can be constructed out of a non-conductive polymeric material such as Mylar® (DuPont High Performance Materials, P.O. Box 89, Route 23 South and DuPont Road, Circleville, Ohio 43113), plush fabric, air curtains anywhere from "0.001 to 0.003" thick and attached to the outer casing 32 of the cleaner or skive blade 42 with an adhesive backing on the flap 300–302. The flap 302 needs to be of sufficient flexibility to allow waste marking particles 60 to pass into the detoning zone from the scavenging zone.

While the invention illustrates three flaps 300–302, the invention is not limited to the specific structure shown in FIG. 3. To the contrary, the invention could include more or fewer flaps, depending upon the specific shape of the various components within the cleaning assembly 11. Also, the invention is not limited to the use of flaps 300–302, but could also make use of fabric plush material to effect the proper sealing between the scavenging and detoning zones. Indeed, the invention is applicable to all such cleaning assemblies that need to control airborne marking particles. Thus, the invention is not limited to the specific embodiments described herein, but is applicable to all structures that utilize flaps or plushes within the cleaning assembly 11 to control airborne marking particles.

The invention physically separates the cleaning assembly 11 into a scavenging zone and a detoning zone using, for example, flaps 300–302 or plushes. Such physically separated zones reduce the volume of marking particles 60 from the scavenging zone to increase the cleaning efficiency of the operating components in the scavenging zone. By providing physical structures that create zones, the invention is superior to conventional structures and contains marking particles within the detoning zone, thereby reducing marking particle contamination of the cleaning (detoning) components of the cleaning assembly.

While the invention has been described in terms of preferred embodiments, those skilled in the art will recognize that the invention can be practiced with modification within the spirit and scope of the appended claims.

PARTS LIST

| Item | Description |
|---|---|
| 1 | primary image member |
| 2 | primary charging station |
| 3 | printhead |
| 4 | development station |
| 5 | intermediate transfer drum |
| 6 | conveyor |
| 7 | transfer backer roller |
| 8 | cleaning station |
| 9 | pre-cleaning erase LED lamp |
| 10 | pre-cleaning charging station |
| 11 | cleaning assembly |
| 12 | pre-cleaning charging station |
| 15 | imaging station |
| 25 | receiving sheet |
| 30 | fuser |
| 32 | casing/housing |
| 34 | cleaning brush |
| 35 | output tray |
| 36 | fibers |
| 39 | power supply |
| 40 | detoning roller |
| 41 | surface |
| 41a | sleeve |
| 42 | skive blade |
| 42a | blade end |
| 42b | scraping blade end |
| 42c | blade ears |
| 50 | auger |
| 51 | collection chamber |
| 60 | marking particles |
| 300 | upper skive flap |
| 301 | lower skive flap |
| 302 | bottom skive flap |

What is claimed is:

1. A conductive fur brush cleaning assembly for an image processing apparatus, said cleaning assembly comprising:

a casing;

a plurality of rotating components within said casing; and a plurality of sealing devices that divide said casing into a scavenging zone and a detoning zone, at least one of said plurality of sealing devices is a plush fabric seal;

wherein said plurality of sealing devices prevent airborne marking particles from traveling from said detoning zone into said scavenging zone.

2. The cleaning assembly in claim 1, wherein said plurality of rotating components include a detoning roller and at least one of said plurality of sealing devices contacts said detoning roller.

3. The cleaning assembly in claim 1, wherein at least one of said plurality of sealing devices comprises a flap.

4. The cleaning assembly in claim 1, wherein said plurality of sealing devices additionally employ another from the list of: air curtains, flaps, and plush fabric seals.

5. A conductive fur brush cleaning assembly for an image processing apparatus, said cleaning assembly comprising:

a casing;

a plurality of rotating components within said casing; and a plurality of sealing flaps connected to said casing that divide said casing into a scavenging zone and a detoning zone, said plurality of sealing flaps are a non-conductive polymeric material;

wherein said plurality of sealing flaps prevent airborne marking particles from traveling from said detoning zone into said scavenging zone.

6. The cleaning assembly in claim 5, wherein said plurality of rotating components include a detoning roller and at least one of said plurality of sealing flaps contacts said detoning roller.

7. The cleaning assembly in claim 5, wherein at least one of said plurality of sealing flaps includes a plush fabric seal.

8. The cleaning assembly in claim 5, wherein said plurality of sealing flaps include a curved end portion that extends into said detoning zone, wherein said curved end portion to rebounds said airborne marking particles toward said detoning zone.

9. The cleaning assembly in claim 5, wherein said plurality of rotating components include a detoning roller, and said plurality of sealing flaps include a bottom flap attached to a lower portion of said casing, by contact with said detoning roller.

10. The cleaning assembly in claim 9, further comprising a skive blade attached to said casing, wherein said skive blade contacts said detoning roller to remove marking particles from said detoning roller, wherein said plurality of sealing flaps include an upper skive flap connected to an upper portion of said casing and to an upper portion of said skive blade.

11. The cleaning assembly in claim 10, wherein said plurality of sealing flaps include a lower skive flap connected to a lower portion of said skive blade, and wherein said lower skive flap is in contact with said detoning roller.

* * * * *